United States Patent [19]

Arvan

[11] 4,314,467

[45] Feb. 9, 1982

[54] KEY RING WITH POSITIVE LOCKING MEMBER

[76] Inventor: John Arvan, 137 Irving Ave., Port Chester, N.Y. 10573

[21] Appl. No.: 147,927

[22] Filed: May 8, 1980

[51] Int. Cl.[3] ..... A47G 29/10

[52] U.S. Cl. ..... 70/456 R

[58] Field of Search ..... 70/456 R, 456 B, 457, 70/458, 459; 24/3 K; 150/40

[56] References Cited

U.S. PATENT DOCUMENTS

| | | | |
|---|---|---|---|
| 1,668,833 | 5/1928 | Thayer | 70/459 |
| 3,589,155 | 6/1971 | Kemp | 70/459 |
| 3,956,913 | 5/1976 | Howard | 70/456 R |
| 4,091,646 | 5/1978 | Sugimoto | 70/456 R |

FOREIGN PATENT DOCUMENTS

| | | | |
|---|---|---|---|
| 563178 | 12/1957 | Belgium | 70/459 |
| 197806 | 10/1977 | France | 70/459 |

*Primary Examiner*—Robert L. Wolfe

*Attorney, Agent, or Firm*—McAulay, Fields & Fisher

[57] ABSTRACT

A key ring is provided wherein a rigid wire loop fits through the opening in the top of keys or other small items to be retained thereon. The wire loop has a break in it in order to permit the keys to be threaded over it. In order to close the opening, the ends of the wire loop are retained in a closure including a housing formed of a front and a back portion defining a cavity therebetween. The front and back portions are releaseably connected together and contain, in the cavity formed therebetween, a retaining member having a pair of aligned slots which receive the ends of the wire loop. In this way, the end portions of the loop are positively supported and locked in the housing.

7 Claims, 4 Drawing Figures

KEY RING WITH POSITIVE LOCKING MEMBER

BACKGROUND OF THE INVENTION

The present invention is directed to a key retaining device, and more particularly, to a key ring formed of a rigid loop having an opening or break through which keys may be threaded thereon. The ends of the loop pass into a housing and engage with a retaining member to support and lock the loop ends in place.

DESCRIPTION OF THE PRIOR ART

Although key retaining devices are known, they generally suffer from inconvenience of use or insecurity in holding the keys. The solid loop type of key ring, wherein a piece of spring metal is coiled onto itself, tends to be fairly secure. However, it is difficult to feed or thread the keys on to such a loop, especially if the person using the key ring has difficulty manipulating small items with his or her hands.

Somewhat more convenient are the snap case type of holders wherein the keys are threaded over small metal loops retained in a slot by an enlarged end of the loop. However, although perhaps somewhat easier to use than the coiled ring discussed above, this device can lose keys accidentally. This is especially true if the device receives somewhat rough treatment.

The more secure devices tend to be either more difficult to use or more expensive because of their relatively complex nature. Further, although prior key rings do hold keys with additional attachments, they cannot be used to display pictures or informational data. Nor can they easily be retrieved if dropped at night where there is no light, as they become practically invisible.

Accordingly, it is an object of the present invention to provide a relatively inexpensive key ring device which includes a positive locking member to prevent the loss of keys.

Another object of the invention is to provide a key ring which is secure even under rough handling conditions.

It is a further object of the invention to provide a key ring device which, if dropped, may be found readily, even in the dark, or which may be used to display pictures or the like without the need to hang additional items therefrom.

BRIEF DESCRIPTION OF THE INVENTION

Briefly, the present invention is a key ring of the solid metal loop type having a positive locking arrangement whereby keys which are threaded over the solid loop can be positively retained thereon. The loop is made of rigid metal having a break therein. The ends of the lop defining the break are received in a housing and secured in place by a retaining member which forms part of the locking arrangement.

More specifically, the housing comprises a front portion and a back portion releasably secured together to define a cavity therebetween. The retaining member, which may be in the form of a luminescent plug of material, is adapted to be received in the cavity. The retaining member is formed having a pair of aligned grooves defined along a diameter of one face thereof. The back housing portion has a threaded stem formed with opposed slots or openings, which slots are alignable with the grooves of the retaining member. The front housing portion has a threaded collar which mates with the threaded stem of the back housing portion.

When the housing portions are separated, the end portions of the loop are received in the slotted openings in the back housing stem portion and also are received in the opposed grooves defined in the retaining member. The front housing portion is then resecured to the back housing portion to close the housing.

Because the groove in the locking retaining member closely holds the opened end portions of the rigid loop, the key ring loop is restrained from working free of the housing.

In the preferred embodiment, the front and back housing portions are formed of clear plastic material. The positive locking member is formed of a luminescent plug of material so that, if the keys are accidentally dropped in the dark, the glow of the center plug will show through the housing portions to permit easy recovery. Further, with clear front and back portions, pictures or advertising can be inserted easily into the housing and positioned between the plug forming the positive retaining member, and either the front or back housing portions, or both. Alternatively, a message can be printed directly on the plug to show through the housing portions. Thus, the key ring can be used for display purposes, and any material on display will be protected from damage by the closed housing.

DESCRIPTION OF THE PREFERRED EMBODIMENT

Figure 1:
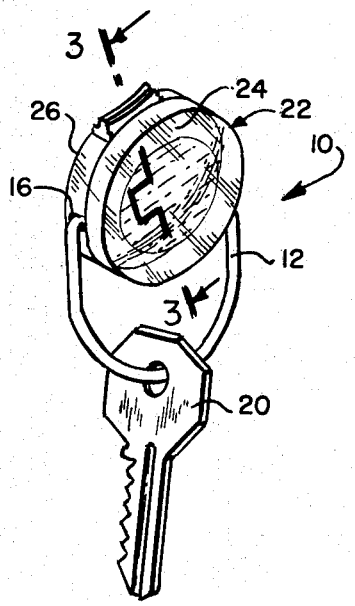
FIG. 1 is a perspective view of a key ring constructed in accordance with the present invention with a key secured thereon.

The present invention is directed to a key ring 10 of the type wherein a key 20 or other object is threaded over a loop 12 and secured thereon. A locking structure represented by numeral 22 is provided to releasably close the ends of loop 12 after the key 20 is inserted on the loop.

With reference to the drawings, the rigid key holding loop 12 has a break 14 therein to define end portions 16, 18 whereby the key 20 can be threaded onto the loop 12. The positive locking structure 22 includes a back or rearward housing portion 24, a front or forward housing portion 26, and a retaining member 28. Optionally, a display disc 30 can be provided, inserted as shown in the drawings between back housing portion 24 and retaining member 28. The disc 30 can also be inserted between front housing portion 26 and retaining member 28. Alternatively, two display discs 30 can be used, one on each side (not shown), or if desired a display 29 can be printed directly onto retaining member 28.

Figure 3:
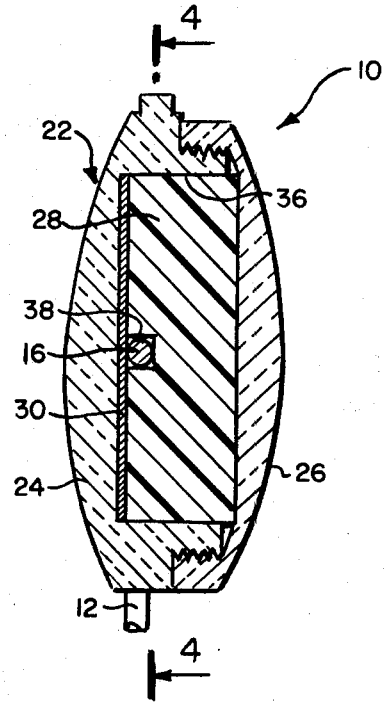
FIG. 3 is a sectional view taken through 3—3 of FIG. 1.
Figure 2:
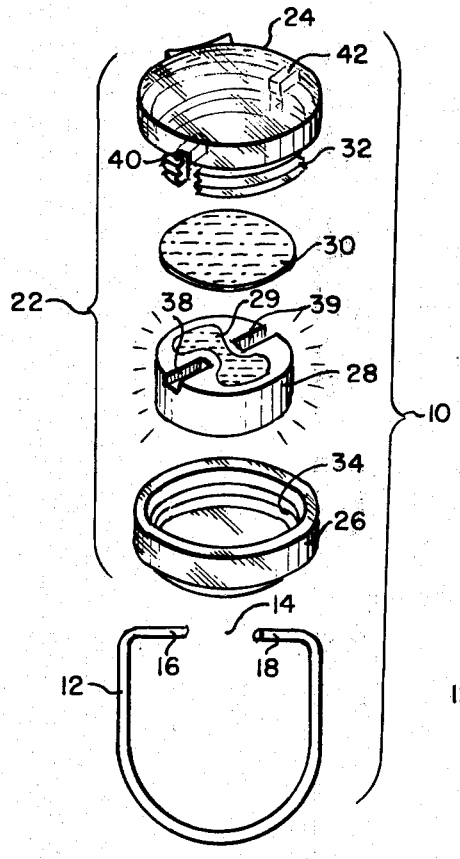
FIG. 2 is an exploded view thereof, without the key.
Figure 4:
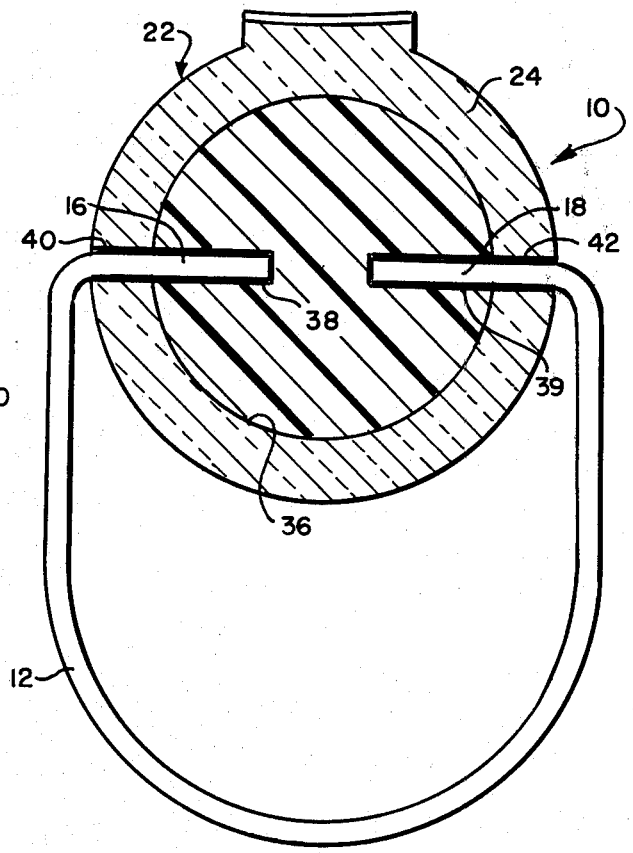
FIG. 4 is a sectional view taken through 4—4 of FIG. 3, with the key removed.

The back housing portion 24 and the front housing portion 26 are releasably securable together, preferably by providing a threaded stem 32 on the back housing portion 24 and a complementary threaded collar 34 on the front housing portion 26. As is readily realized, this can be reversed if desired, or other fastening means used. Disposed between the housing portions 24, 26 is a cavity 36. The retaining member 28 is sized to be closely contained in cavity 36 (FIGS. 3 and 4).

The retaining member 28 is formed having a pair of spaced retaining grooves 38, 39 positioned along the diameter of one face thereof. The grooves 38, 39 are sized to receive the end portions 16, 18, respectively, of rigid loop 12. Thus, grooves 38, 39 preferably have a width and depth substantially corresponding to the cross sectional dimensions of the loop end portions 16, 18. Although grooves 38, 39 can be formed as a single continuous groove, the dual construction shown herein is preferred as it reduces the side movement of the rigid loop 12 by providing an abutment for the ends of end portions 16, 18.

A round sectioned wire is shown bent to form loop 12, and the grooves 38, 39 are shown with a square section, the height and width of which are about the same as the diameter of the wire loop 12. This is a preferred embodiment from the point of view of manufacturing the device 10. As would be obvious, other shapes for the grooves as well as for the rigid loop would work. A rounded wire loop 12 does have the advantage over polygonal sectioned material in that a round section pivoting in grooves 38, 39 will minimize wear on the grooves.

The head or collar of back housing portion 24 has side openings or slots 40, 42 which extend through the threaded stem 32. The retaining grooves 38, 39 can be aligned with slots 40, 42 by rotating retaining member 28 in cavity 36. If a rectangular cavity and retaining member 28 are used (not illustrated), then locking grooves 38, 39 must be formed in alignment with side openings 40, 42 as movement between retaining member 28 and back housing portion 24 will not be possible. Thus, the round shape of retaining member 28 is preferred for ease of assembly and alignment. Once retaining member 28 is inserted in place, it can be rotated until proper alignment between grooves 38, 39 and side slotted openings 40, 42 is accomplished.

For the preferred construction, back and front housing portions 24, 26 are each formed of clear plastic available under the name LEXAN (Trademark of General Electric Company, One River Road, Schenectady, N.Y., for a thermoplastic polycarbonate condensation product of bisphenol-A and phosgene). The locking member may be any similar plastic material, but is preferably made of a polymer having luminescent qualities. The display disc can be any suitably sized display or photograph. The rigid loop 12 is preferably a "D" shaped loop of spring metal wire.

Typically, a one-eighth inch piece of metal wire is bent into a loop of any desired shape to form the rigid loop 12. About ¼" space between the open ends is satisfactory to permit inserting the keys or other items over the loop. Similarly, a ¼" space has been successfully used between the opposed grooves 38, 39 of retaining member 28.

If desired, the display insert 30 can be eliminated and a message or other display 29 imprinted directly on retaining member 28. Pictures or other items can also be inserted by the person using the key ring.

In assembling key ring 10, keys 20 and other items as desired are threaded onto rigid loop 12. The loop is then positioned in back housing portion 24 with the loop ends 16, 18 passing through slots 40, 42 in stem 32. The retaining member 28 is then inserted into cavity 36 and rotated, if necessary, to align grooves 38, 39 with slots 40, 42 whereby loop ends 16, 18 are received within said grooves. Front housing portion 26 is then screwed or otherwise fastened to back housing portion 24 to close the housing with the loop ends 16, 18 locked in place.

As illustrated in FIG. 4, retaining grooves 38, 39 reinforce end portions 16, 18 against being deformed by lateral forces of the key 20 on the rigid loop 12. That is, by being closely received and supported in retaining grooves 38, 39, the loop ends are restrained from being withdrawn from retaining member 28 by forces pulling or twisting the keys. In this way, the loop 12 is securely locked against accidental opening.

Pictures, advertisements or any desired display can be printed on display inserts 30. Alternatively, they can be printed on retaining member 28, as represented by numeral 29, or on the other face thereof. Of course, no display need be provided initially and this can be added at the option of the final consumer. In those instances where a display insert is used, it would be positioned between the retaining member 28 and either one of the forward or rearward housing portions, or both.

While a preferred embodiment of the invention has been shown and described in detail, it will be readily understood and appreciated that various changes or modifications thereof may be made without departing from the spirit and scope of the invention as set forth in the appended claims.

What is claimed is:

1. A positive locking key ring comprising:

(a) a rigid key loop having an opening therein to define loop ends whereby keys or other items having an opening therethrough can be threaded onto the loop;

(b) a front housing member;

(c) a back housing member, said back housing member formed with opposed slots disposed to receive the end of said loop;

(d) interengaging means on said housing members operable to releasably connect said front housing portion to said back housing portion with said portions defining a cavity therebetween; and (e) a retaining member sized to substantially fill said cavity and having a pair or aligned grooves formed in a face thereof, said grooves being alignable with said slots and sized to receive the ends of said loop to securely hold the key loop in the housing when the housing portions are connected together.

2. The key ring of claim 1 further comprising a display member operable to be disposed between said retaining member and said back housing member, said back housing member being formed of transparent material.

3. The key ring of claim 1 wherein at least one of said housing portions is formed of transparent material and said retaining member is formed of luminescent material whereby the key ring may be rendered visible in the dark.

4. The key ring of claim 1 wherein said back housing portion has a stem and said front housing portion has a collar; said interengaging means comprising complementary threads formed on said stem and said collar.

5. The key ring of claim 1 wherein said back housing member has a stem and said opposed slots are formed in said stem.

6. The key ring of claim 1 or 5 wherein said retaining member is circular and said aligned grooves are disposed along a diameter thereof.

7. The key ring of claim 1 wherein said retaining member carries a display message.

* * * * *